United States Patent [19]

Plantard

[11] 4,005,339

[45] Jan. 25, 1977

[54] PLASTIC FILLING NOZZLE FOR USE AT FILLING STATIONS

[75] Inventor: Maurice Plantard, Antony, France

[73] Assignee: Shell Oil Company, Houston, Tex.

[22] Filed: June 2, 1975

[21] Appl. No.: 583,124

[52] U.S. Cl. ..... 217/2 J; 141/392

[51] Int. Cl.[2] ..... H05F 3/00; B65B 3/04

[58] Field of Search ..... 141/311, 392, 207–229, 141/192; 317/2 R, 2 J; 174/6, 47

[56] References Cited

UNITED STATES PATENTS

| | | | |
|---|---|---|---|
| 2,108,759 | 2/1938 | Turman | 317/2 J |
| 2,263,221 | 11/1941 | Merrill | 317/2 J |
| 3,502,121 | 3/1970 | Moore et al. | 141/207 |

*Primary Examiner*—Houston S. Bell, Jr.
*Attorney, Agent, or Firm*—Ronald R. Reper

[57] ABSTRACT

The present invention relates to a fuel dispensing nozzle made of plastic material and having means for conducting an electrical charge from the inlet of a receiving vessel to the source of the liquid connected to said nozzle.

1 Claim, 1 Drawing Figure

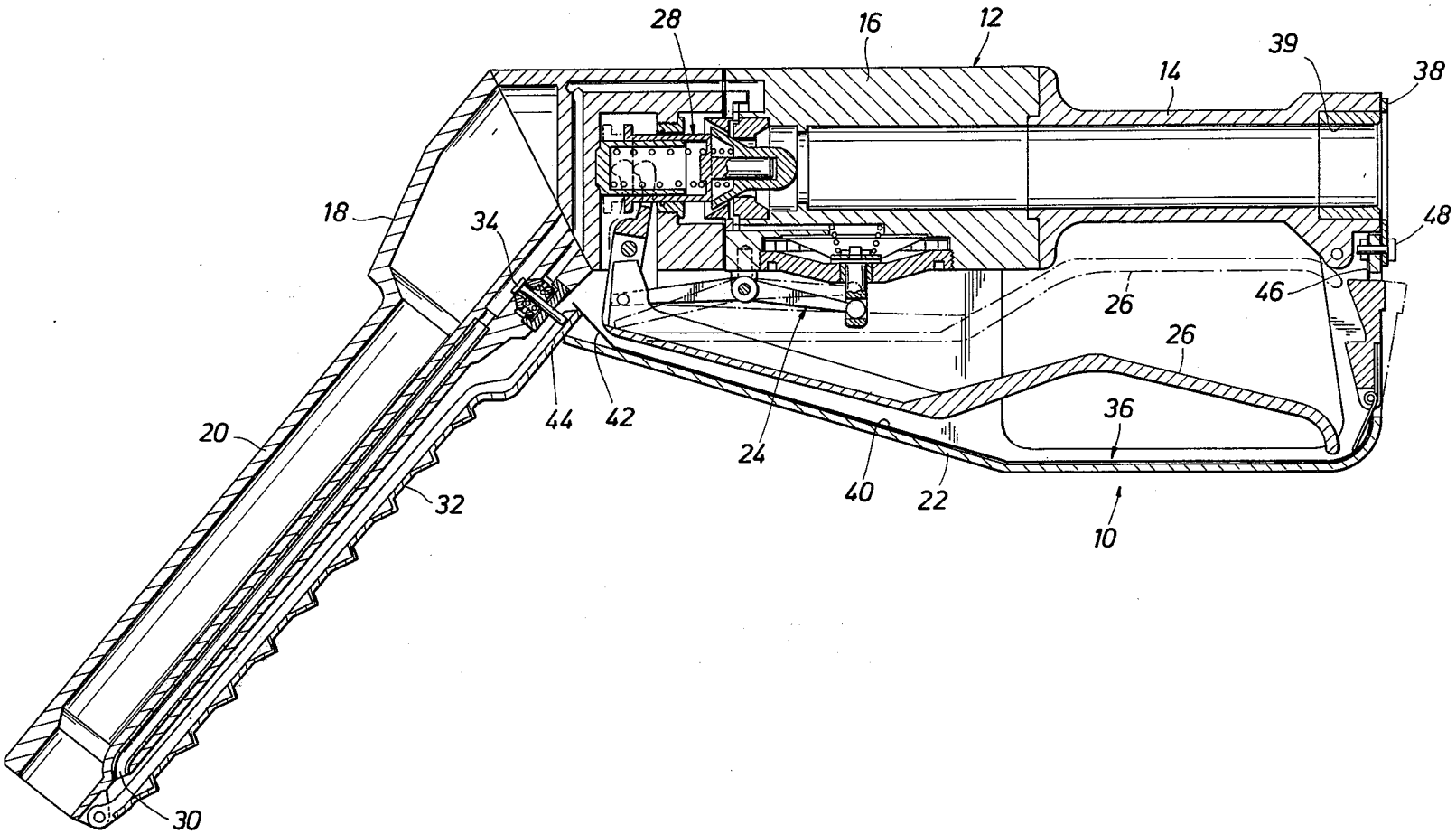
38
48
39
46
14
26
26
36
10
12
22
16
40
24
28
42
44
34
32
18
20
30

PLASTIC FILLING NOZZLE FOR USE AT FILLING STATIONS

BACKGROUND OF THE INVENTION

A dispensing nozzle is essentially a manually or semi-automatically operated shut-off device intended to be fitted to the end of a delivery hose connected to the delivery orifice of a fuel pump used for filling a tank, such as the tank of a vehicle.

In French Pat. No. 7,213,419, filed Apr. 17, 1972, for an "automatic shut-off device for fuel dispensing nozzles", it has been suggested to make the various constituent parts of the body of the nozzle of rigid plastic, which has numerous advantages, such as light weight, cleanliness, easy manufacture, low cost price, etc.

However, the property of electrical insulation inherent in the plastic used poses the problem of earthing i.e. grounding the electrical potential of the vehicle. The vehicle can actually have a potential very different from that of the delivery pump, which is itself generally earthed. Such a difference in potential can result in a discharge and a spark at the nozzle outlet spout during fuel delivery, which obviously is particularly dangerous.

The invention aims at overcoming this drawback by connecting the potential of the pump to the vehicle whose tank is to be filled.

SUMMARY OF THE INVENTION

The invention therefore comprises a nozzle assembly for delivery of a liquid from a source to a liquid receiver having an inlet, said nozzle assembly comprising: a rigid plastic nozzle including a nozzle inlet adapted for connection to a source of liquid, said source having electrical path means communicating with an electrical ground; a nozzle outlet, a nozzle housing coupling said nozzle inlet and said nozzle outlet and control means for controlling liquid flow from said nozzle inlet through said nozzle housing to said nozzle outlet, an annular conductor disposed on said nozzle and adapted to make electrical connection with the electrical path means of said liquid source, electrical conductive means disposed on such nozzle outlet to make contact with said liquid receiver inlet, and electrical connective means for coupling said electrical conductive means with said annular conductor.

BRIEF DESCRIPTION OF THE DRAWING

The Drawing is a cross sectional view of one embodiment of the nozzle assembly of this invention.

DESCRIPTION OF THE PREFERRED EMBODIMENTS

The body of the nozzle essentially comprises an attachment part in the form of a handle, a housing enclosing the delivery control mechanism which is actuated by a pivoting lever under the control of the operator, an end part terminating in the discharge outlet spout, and a protective part in the form of a trigger guard arranged beneath the attachment part so as to prevent accidental operation of the pivoting lever. According to the invention the electrical connective means is preferably a metal strip that is attached to the protective part and that presents one free end that can be kept in resilient contact with the electrical conductive means disposed on the nozzle outlet, the other end of the strip being permanently connected to the said annular conductor which is also basically attached to the protective part of the nozzle. The annular conductor is disposed in said nozzle to make contact with electrical path means of the source of liquid e.g. a ground wire built into the delivery hose.

The invention will be elucidated by reference to the following description relating to the attached drawing, the drawing being given solely by way of example, the single FIGURE being a cross-section of a nozzle according to the invention.

Number 10 in the FIGURE indicates a dispensing nozzle intended to be fitted to the end of a source of liquid i.e. a delivery hose (not shown), connected to the delivery orifice of a fuel pump (not shown) for filling a liquid receiver inlet (not shown) e.g. the tank of a motor vehicle.

The nozzle 10 essentially comprises a housing 12 that is assembled from several parts made of rigid plastic, namely: an attachment part 14 in the form of a handle, a central part 16 in one or several pieces, an end part 18 terminating in a nozzle outlet discharge spout 20, and a protective part in the form of a trigger guard 22 arranged beneath the attachment part 14 and the central part 16.

A delivery control mechanism 24 is set in part 16 of the housing 12 and is actuated by a lever 26 pivoting between the protective part 22 and the attachment part 14, so that is can be controlled by the operator. The mechanism 24, shown in the drawing, is of a conventional type, operated semi-automatically, in which the shut-off valve 28 can be operated either manually by means of the lever 26 or held open automatically until the lever of the fuel poured into the tank reaches an opening 30 arranged at the top of the nozzle outlet discharge spout 20.

A proper-insertion safety device is advantageously provided by the arrangement of a lever 32, pivoting at the end of the spout 20, to effect upon introduction of the latter into the tank filling orifice, the opening of a safety valve 34 which will keep the shut-off valve 28 open.

According to the invention, an electrical connective means 36 is disposed to contact both annular conductor 38 arranged near the nozzle inlet attachment orifice 39 of part 14 to the delivery hose (not shown) and electrical conductive means e.g. an elongated conductor arranged along the nozzle outlet discharge spout 20 which conductor can, advantageously, be constituted by the above-mentioned metal lever 32. Electrical connective means 36 permits the tank filling orifice to be connected to the electrical path means e.g. the earthing conductor usually provided in the source of liquid e.g., the delivery hose.

In a preferred arrangement, the electrical connective means 36 is a metal strip 40 that is basically attached to the inner face of the protective part 22 alone. One end 42 of the strip 40 is free and kept in contact with the end 44 of the conductor-lever element 32 by the resilience of this strip. The other end 46 of the strip 40 is connected to the annular conductor 38 by a metal rivet or analogous fastening means 48 to hold in place the end 46 as well as the element 38 on the back section (attached to part 14) of the protective part 22. With such an arrangement it is readily appreciated that the electrical connection is basically made by the part 40 in such a way that the assembly and/or dismantling of one or several of parts 14, 16, 18, 20 and/or 22 does not present any problems with respect to this connection.

It is understood that the invention is not limited to the embodiment herein described and presented. Numerous modifications can be made, especially in the specific form of the control mechanism, in the number of constituent parts of the housing 12 and in the design of the electrical conductor element 32 and annular conductor 38, as well as in that of the electrical connective means 36, without going beyond the scope of the invention.

The plastic material of the nozzle can be any of the rigid synthetic polymeric materials which are resistant to the particular liquids to be dispensed. Numerous resins and molding compounds are well known in the art and are described for example in Modern Plastics Encyclopedia 1970–1971 published by McGraw Hill Incorporated, New York.

The electrical conductor and connective elements are preferably metals having good electrical conductive properties such as copper, iron or aluminum and the like which metal may be coated with a corrosion resistant material such as zinc, tin or chromium.

What is claimed is:

1. An electrically conductive nozzle assembly for delivery of a liquid from a source to a liquid receiver having an inlet, said nozzle assembly comprising: (1) a rigid plastic nozzle including a nozzle inlet adapted for connection to a source of liquid, said source having electrical path means communicating with an electrical ground; a nozzle outlet; a nozzle housing coupling said nozzle inlet and said nozzle outlet; control means for controlling liquid flow from said nozzle inlet through said nozzle housing to said nozzle outlet; and a proper insertion safety valve for preventing discharge of liquid through said control valve unless the nozzle is properly inserted into the liquid receiving inlet; and (2) means for conducting an electrical charge comprising an annular conductor disposed on said nozzle and adapted to make electrical connection with the electrical path means of said liquid source; electrical conductive means disposed on said nozzle outlet to make contact with said liquid receiver inlet, said electrical conductive means being a lever pivoting on said nozzle and operatively connected to said safety valve for opening said safety valve when the nozzle outlet is introduced into the liquid receiver inlet; and electrical connective means for coupling said electrical conductive means with said annular conductor.

* * * * *